US005378330A

United States Patent [19]

Li et al.

[11] Patent Number: 5,378,330

[45] Date of Patent: Jan. 3, 1995

[54] METHOD FOR POLISHING MICRO-SIZED STRUCTURES

[75] Inventors: Hong Li, Cambridge; Stephen D. Senturia, Brookline; David Volfson, Boston, all of Mass.

[73] Assignee: Panasonic Technologies, Inc., Cambridge, Mass.

[21] Appl. No.: 59,466

[22] Filed: May 7, 1993

[51] Int. Cl.[6] ..... C25F 3/16

[52] U.S. Cl. ..... 204/129.1; 204/129.6; 204/129.65; 156/643; 219/69.17

[58] Field of Search ..... 204/129.1, 129.6, 129.65; 156/643; 219/69.17

[56] References Cited

U.S. PATENT DOCUMENTS

| | | | |
|---|---|---|---|
| 3,174,920 | 3/1965 | Post | 204/129.65 X |
| 3,239,441 | 3/1966 | Marosi | 204/129.25 |
| 3,637,466 | 1/1972 | Girard | 204/1.11 |
| 3,689,387 | 9/1972 | Jumer | 204/129.65 X |
| 3,703,452 | 11/1972 | Beroff et al. | 204/129.1 |
| 4,038,702 | 8/1977 | Sawyer | 204/129.1 |
| 4,072,588 | 2/1978 | Diepers | 204/129.43 |
| 4,234,397 | 11/1980 | Torrey | 204/129.35 |
| 4,276,132 | 6/1981 | Fettel et al. | 204/129.1 |
| 4,448,655 | 5/1984 | Inoue | 204/129.1 |
| 4,475,996 | 10/1984 | Inoue | 204/129.46 |
| 4,477,324 | 10/1984 | Cline | 204/129.1 |
| 4,487,671 | 12/1984 | McGeough | 204/129.1 |
| 4,492,739 | 1/1985 | Cline | 428/611 |
| 4,542,579 | 9/1985 | Poponiak et al. | 29/576 W |
| 4,977,038 | 12/1990 | Sieradzki et al. | 428/610 |
| 5,035,780 | 7/1991 | Suzuki et al. | 204/129.35 |
| 5,137,617 | 8/1992 | Helfet et al. | 205/68 |
| 5,149,404 | 9/1992 | Blonder et al. | 204/129.1 |

*Primary Examiner*—Donald R. Valentine
*Attorney, Agent, or Firm*—Ratner & Prestia

[57] ABSTRACT

A method for polishing a substrate having at least one micro-sized structure. The method includes identifying a first region of the substrate on which a micro-sized structure is to be located. The first region is the region in which polishing is desired. A second region of the substrate, in which polishing is not desired, is also identified. An adhesion promoter is optionally applied to the substrate. The second region of the substrate is coated with a selected coating material that does not degrade substantially when exposed to a selected electrolyte. Material is removed from the first region, exposing a micro-sized structure. The coating material may be removed by the same machining process that forms the micro-sized structure. The substrate is submerged in the selected electrolyte so that the first region is exposed to the electrolyte. The first region of the substrate is electropolished. The coating is then optionally removed.

20 Claims, 5 Drawing Sheets

METHOD FOR POLISHING MICRO-SIZED STRUCTURES

BACKGROUND OF THE INVENTION

Microelectromechanical systems (MEMS) are devices with overall dimensions typically less than a millimeter, and individual feature sizes on the order of microns. MEMS are fabricated using integrated-circuit (IC) technology enhanced with silicon micromachining, laser machining, laser-chemical micro maching, non-planar lithography, or micro-electro-discharge machining (micro-EDM). Polishing is essential for making very fine, well defined micro-sized structures, because some of the fabrication methods listed above often produce very rough surfaces.

Polishing micro-sized structures is very different from polishing macro-sized structures. A special method is required to obtain a fine surface finish in micro-sized structure.

When general electroplating methods are applied to polish a substrate that contains a micro-sized structure, the electrical current used in electropolishing tends to concentrate at the sharp corners and features. This results in material being etched off at the sharp features, and rounding of the features The surfaces of the micro-sized structures, however, either remain rough, if the micro-sized features are not as sharp as the corners of the macro features; or the micro-sized features are destroyed before being polished; if the corners of the substrate are not very sharp (for example, if a ballshaped substrate is used).

One solution is polishing of micro-sized structures using a micro-EDM machine—the same tool that may be used to produce the micro-sized structures. The need for specialized micro-EDM machine, with sophisticated controls and specially made micro-sized electrodes, make this method difficult. Also the need to polish one feature at a time makes polishing by this method cost prohibitive.

SUMMARY OF THE INVENTION

The invention is a method for polishing a substrate having at least one micro-sized structure. The method includes identifying a first region of the substrate on which a micro-sized structure is to be located. The first region is the region in which polishing is desired. A second region of the substrate is also identified, such that polishing of the second region is not desired.

The second region of the substrate is coated with a selected coating material that does not degrade substantially when exposed to a selected electrolyte. Material is removed from the first region, exposing a micro-sized structure. The substrate is submerged in the selected electrolyte so that the first region is exposed to the electrolyte and is electropolished.

Figure 1:
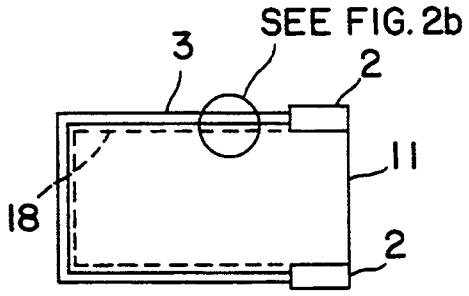
FIG. 1 is a cross-sectional view of a coated substrate.

FIG. *2a* is an elevation view of apparatus for micromachining the substrate shown in FIG. 1, FIG. *2b* is an enlarged view of a portion of the coated substrate shown in FIG. 1, prior to the micro-machining step.

FIG. *2c* is an enlarged view of the substrate portion shown in FIG. 1, after machining the coating.

FIG. *2d* is an enlarged view of the substrate portion shown in FIG. 1, after machining the micro-structure.

Figure 3:
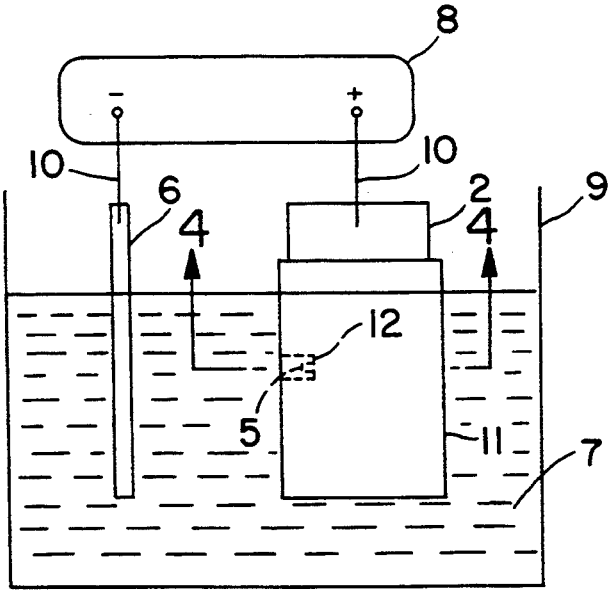

FIG. 3 is a schematic diagram of the apparatus for electropolishing the substrate shown in FIG. 1.

Figure 4:
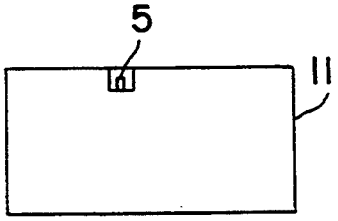
Figure 2A:
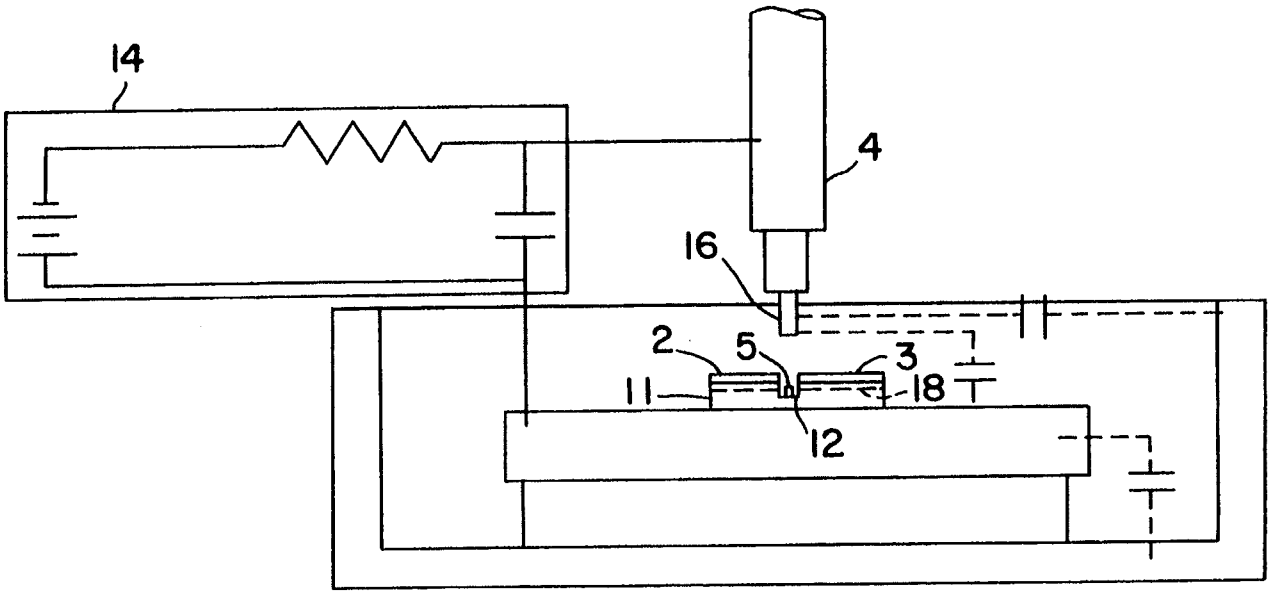
Figure 2B:
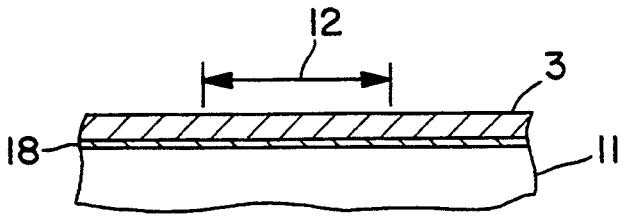
Figure 2C:
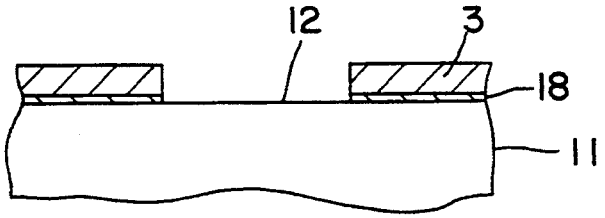
Figure 2D:
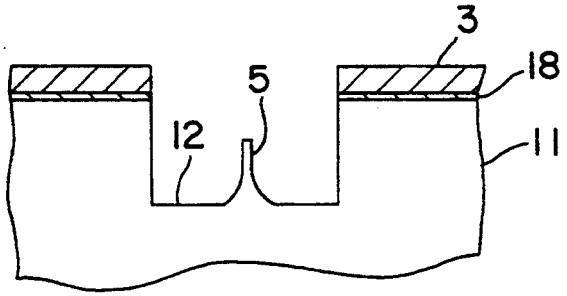

FIG. 4 is a cross-sectional view showing the substrate of FIG. 3 after polishing and removing the coating layer.

Figure 5:
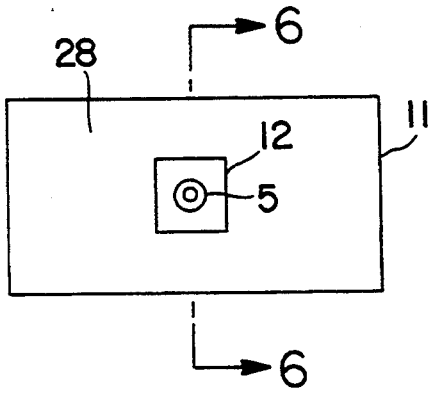

FIG. 5 is a plan view of an uncoated substrate that has a micro-sized structure.

Figure 6:
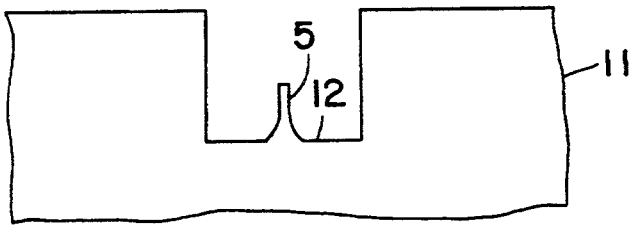

FIG. 6 is an enlarged cross-sectional view of a portion of the substrate shown in FIG. 5.

Figure 7:
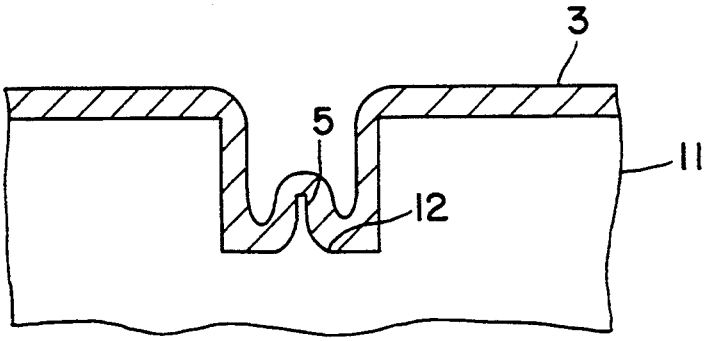

FIG. 7 is a cross-sectional view of the substrate portion shown in FIG. 6, after application of the coating.

Figure 8:
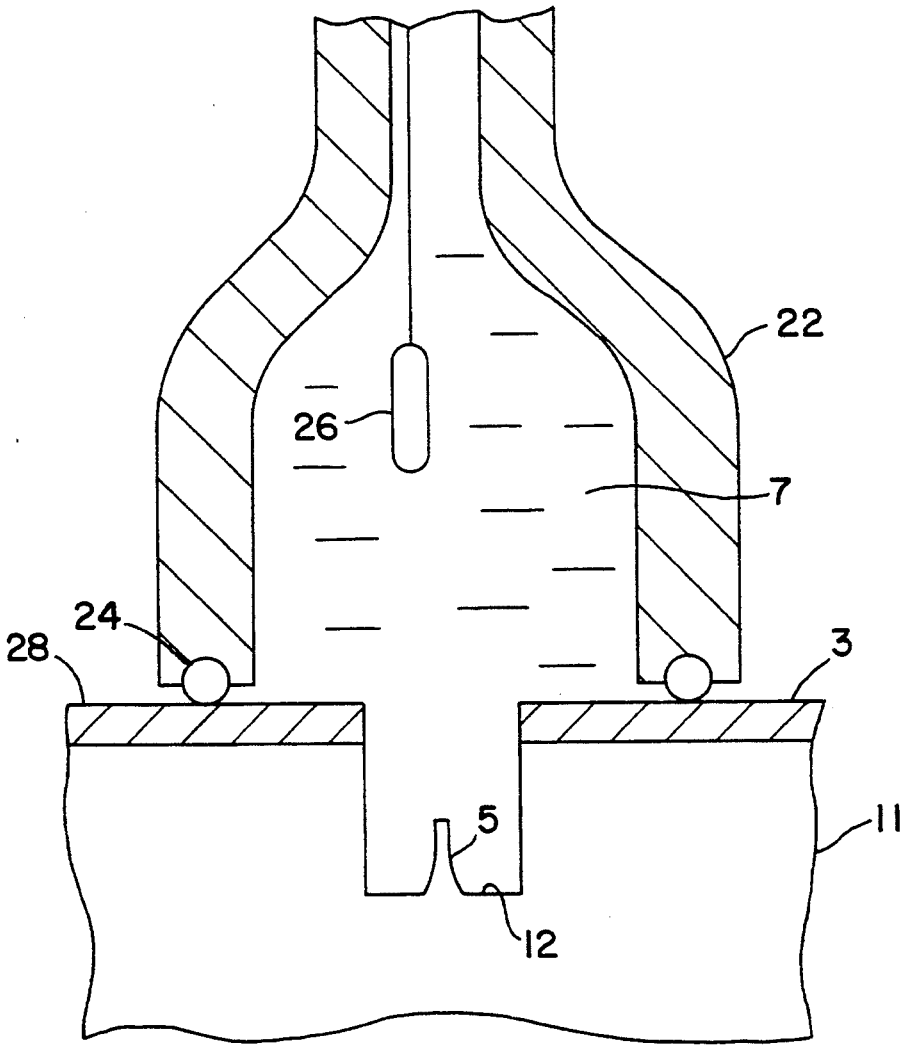

FIG. 8 is a cross sectional view of an apparatus for selectively electropolishing the substrate shown in FIG. *2d*.

DETAILED DESCRIPTION OF THE INVENTION

Referring now to the drawings, an exemplary embodiment of the present invention is described in detail below.

FIG. 1 shows a cross-section view of the coated substrate 11. Substrate 11 is formed of a material that may include conductive materials, such as metals, or semiconductive materials, such as silicon. Any substrate within the range of micrometers to meters may be used. Contact points 2 are used for the electropolishing process. Contact points 2 are also used for the micro-structure forming process (shown in FIG. *2a*), if the machining method requires electrical connection to the substrate. Substrate 11 is cleaned, coated and dried before processing.

Substrate 11 has a coating layer 3. Preferably, the material from which the coating layer 3 is made is selected so that coating 3 is not degraded by the electrolyte 7, cleaning chemicals that may be used prior to polishing, or the polishing solution that may be used in the micro-machining process (shown in FIG. *2a*). Also, the coating should be of a type that is removable by the machining method that is used to make the micro-sized structure 5, as shown in FIG. *2a*. In the exemplary embodiment, the coating 3 is applied before the micro-sized structure 5 is machined.

Alternatively, the coating may be of a type that is removable by any other suitable means such as photolithography. An example of a suitable coating 3 material is a photo-resist material. According to an alternative embodiment of the invention, the coating 3 may be applied selectively to the second region 28 that does not require polishing, after the micro-sized structure 5 is formed. Another alternative is to form the micro-sized structure 5, coat the entire substrate 11, and then selectively remove the coating 3 from the region 12 containing the micro-sized structure.

The thickness of the coating layer 3 depends on the material used. It should be within a range that is thick enough to withstand the polishing electrolyte 7 (shown in FIG. 3), the cleaning chemicals and the machining liquid that could be used during the process. Also, coating 3 should be thin enough to be cut by the micro-machining technology used to make the micro-sized structure 5 (shown in FIG. *2a*).

If photolithography is used to define openings in coating 3, the coating should be formed from a suitable photoresist. Using a negative photoresist, the photoresist is applied to the entire substrate . A mask is formed to cover a first region 12 of the substrate 11 on which micro-sized structure 5 is to be located. The remainder of the substrate forms a second region 28 that is exposed to a light source to modify the photoresist, hardening the photoresist in the second region 28. The unexposed photoresist in the first region 12 is then dissolved away. Now only the first region 12 is uncoated.

It is understood by one of ordinary skill in the art that a positive resist could also be used for coating 3. If a positive resist is used, the mask covers the second region 28, and the first region 12 is exposed to light. The positive resist is then dissolved from the first region 12.

Adhesion promoter 18 may be used prior to depositing the coating material 3 to improve adhesion between the substrate 11 and the coating layer 3. This reduces or eliminates peeling of the coating 3 from the substrate 11 during the processing. Undercutting is avoided, and dimensional control during the polishing step is enhanced. The method of applying adhesion promoter 18 may be the same as the coating method. For example, adhesion promoter 18 and coating 3 may both be applied by spin coating. It is understood by one skilled in the art that the type of adhesion promoter chosen and the method of applying the adhesion promoter 18 depend on the materials selected for substrate 11 and coating 3.

FIG. *2a* is a schematic view showing a micro-machining apparatus 4 for forming micro-sized structure 5 on the substrate 11. Exemplary Micro-EDM machines suitable for the machining step include the Model MG-ED07 NC Micro hole Boring Machine and the Model MG-ED05 NC Micro shaft Turning Machine, both manufactured by Matsushita Research Institute Tokyo, Inc., of Kawasaki, Japan. Micro-EDM machine 4 includes a power supply 14, and an electrode 16 that delivers a precisely controlled electrical discharge to the workpiece 11 to remove small amounts of material accurately.

Although FIG. *2a* shows a micro-EDM apparatus 4, alternative micro-machining apparatus 4 may include micro drilling and silicon micro-machining. Micromachining apparatus 4 is used to form a micro-machined micro-sized structure 5. The substrate is electrically connected with the apparatus 4, if electrical contact is required for the micro-machining method used. The size of the micro-sized structure 5 is in the range of micrometers to millimeters. Optionally, a plurality of micro-sized structures may be formed.

During the micro-machining process, coating 3 is removed in the region 12 that includes micro-sized structure 5. More specifically, the coating is removed from the areas 12 for which electro-polishing is desired. Typically, the micro-sized structure is polished and larger features are not polished. However, the electro-polishing method according to the invention may be used for fine control of feature dimensions, and the coating 3 may be removed from any area in which precisely controlled material removal is desired.

FIG. *2b* is an enlarged view of a portion of the coated substrate 11 shown in FIG. 1, prior to the micro-machining step. Region 12 is the first regions in which a micro-sized structure is to be formed. FIG. *2c* is a cross sectional view of the substrate portion shown in FIG. *2b*, after machining the coating. Preferably, the coating 3 is machined during the same micro-machining process that forms micro-sized structure 5. FIG. *2d* is a cross sectional view of the substrate 11 portion shown in FIG. *2c*, after removing material by machining the substrate 11 to expose a micro-sized structure 5. The structure 5, as shown in FIG. *2d*, is ready for electropolishing.

An alternate method for preparing the substrate is shown in FIGS. 5, 6 and 7. FIG. 5 is a plan view of an uncoated substrate 11, having a micro-sized structure 5. FIG. 6 is a cross-sectional view of a portion of the substrate 11 shown in FIG. 5. The micro-machining is preformed prior to applying the coating 3. For this method, coating 3 is a photoresist. FIG. 7 is a cross-sectional view of the substrate 11 portion shown in FIG. 6, after application of the coating 3. Am ask (not shown) is applied to the cover the first region 12 if a negative resist is used (or the second region 28, if a positive resist is used), and the substrate is exposed to light to develop the resist. The resist is then dissolved from the first region 12, exposing the microsized structure. After dissolving the coating 3 from first region 12, the substrate 11 appears as shown in FIG. *2d*. The substrate 11 is now ready for electro-polishing.

FIG. 3 is useful for describing the process of electro-polishing. Substrate 11 is placed in an electrolyte container 9, filled with an electrolyte 7. The substrate 11 is used as an anode and is electrically connected by wires 10 to the power supply 8. An electrode 6 is used as the cathode for polishing, and is coupled by the connecting wires 10 to power supply 8. Because the surfaces in the second regions 28 for which polishing is not desired, are covered with the coating layer 3, polishing is concentrated on the exposed surfaces 5 and 12 of the first region.

An exemplary polishing electrolyte is phosphoric acid and/or sulfuric acid, with a polishing current density of 20–50 amperes per square foot, and a polishing time of 60–120 seconds. When the current is applied, atoms of material in the first region (including micro-sized structure 5) are ionized and migrate to the cathode 6. In the resulting etching of the micro-sized structure 5, material is removed most rapidly from raised, rough spots, producing a smooth, polished surface.

After polishing, the coating layer may be removed, if desired. The removing method may include chemical etching and/or plasma etching. FIG. 4 shows the substrate 11 with a micro-sized structure 5 after the coating layer has been removed.

FIG. 8 shows an alternative electro-polishing apparatus according to the invention. This apparatus may be used if it is impractical to immerse the whole substrate 11 in the electrolyte. For example, the substrate may be too large, or it may not be practical to coat the whole substrate with the coating 3. This method may also be used if the substrate includes any devices or structures that should not be exposed to the electrolyte 7. This method includes selectively applying the electrolyte 7 or polishing liquid to only a portion of the substrate; the portion includes the first region 12 in which the micro-sized structure 5 is formed.

Referring now to FIG. 8, a tube or container 22 has an opening at its bottom. Sealing means, such as an 0-ring 24 is applied to the bottom surface of the tube 22. The polishing solution 20 is poured into the tube 22. The 0-ring 24 prevents the solution from escaping. A cathode 26 is placed in the solution 20. The substrate 11 is connected to the power supply, by wires 10, similar to the embodiment of FIG. 3, so that the substrate 11 is the anode. After the electro-polishing is completed, the polishing liquid 7 may be removed by inserting a small tube (not shown) coupled to a vacuum (not shown) into tube 22, to draw the liquid 7 out. Tube 22 may then be removed without spilling the liquid on the substrate. Alternatively, if there is no risk of harming any device or structure on the substrate through contact with the electrolyte, then the tube 22 may be lifted, and the electrolyte 7 allowed to pour out.

Although the above description refers to only a the micro-sized structure 5 as being singular, it is understood that substrate 11 may have a plurality of "first regions", each having a microsized structure. Similarly, the substrate 11 may have a plurality of second regions, for which electropolishing is not desired.

EXAMPLE

The following example of a method according to the present invention was carried out by means of the process shown in FIGS. 1 through 4.

A 20 by 15 millimeter stainless steel substrate 11, 3 millimeters thick, was used. The substrate 11 was rinsed in solutions of acetone, methanol and deionized water without allowing the sample to dry between rinses. Then substrate 11 was air-dried and dehydration baked at 300° C. for an hour.

Prior to depositing the coating, a layer of adhesion promoter was spin coated onto the substrate and allowed to dry. Then the coating 3 was formed by spin coating substrate 11 with photoresist KTI820 TM. The thickness of coating 3 was controlled by the spin speed. Then the sample was softbaked at 90° C. for an hour and then hardbaked at 120° C. for another hour.

The micro structures 5 were machined on the substrate 11 using the micro-EDM machine 4. The micromachining process also removed the coating 3 from the micro-sized structures 5. The surface roughness of the micro structure after machining was rougher than 0.1 microns.

After micro-machining, the substrate 11 was cleaned prior to polishing. The cleaning process consisted of immersing the substrate in Oakite STC non-silicated alkaline cleaner with ultrasound agitation for 30 min. Concentration of the solution was 25% by volume and operating temperature was 25° to 60° C.

The electropolishing was conducted in the solution 7 containing 63% by volume phosphoric acid, 15% by volume sulfuric acid and the balance was water. Temperature ranged from 35° to 65° C. A current density of 50 Amperes/foot$^2$ at 4 Volts was used. The substrate 11 was polished for 90 sec.

To passivate the polished surface, the substrate 11 was immersed in the solution containing 30% nitric acid, 10% sodium dichromate and deionized water at 50°–60° C. After the rinse, the substrate 11 was dried in filtered forced dry air oven at 60°–65° C. The coating layer 3 was removed by plasma etching. Mirror smooth surfaces were obtained inside the micro-structure after electropolishing.

It is understood by one skilled in the art that many variations of the embodiments described herein are contemplated. While the invention has been described in terms of exemplary embodiments, it is contemplated that may be practiced as outlined above with modifications within the spirit and scope of the appended claims.

What is claimed:

1. A method for polishing a substrate having at least one micro-sized structure, comprising the steps of:

(a) identifying a first region of the substrate on which a micro-sized structure is to be located, and on which first region polishing is desired, and a second region of the substrate, such that polishing is not desired in the second region, said second region having features which would interfere with the micropolishing of the first region if the first and second regions were micropolished together;

(b) coating the substrate with a selected coating material that does not degrade substantially when exposed to a selected electrolyte;

(c) selectively removing the coating from the first region, to expose the micro-sized structure without removing the coating from the second region;

(d) exposing the first region of the substrate to the electrolyte; and (e) electropolishing the first region of the substrate.

2. A method in accordance with claim 1, wherein step (d) includes submerging the substrate in the selected electrolyte.

3. A method in accordance with claim 1, further comprising the step of removing the coating material after step (e).

4. A method in accordance with claim 1, wherein the coating material is a photoresist.

5. A method in accordance with claim 4, wherein step (c) includes the step of micro-machining the first region to remove the coating material.

6. A method in accordance with claim 5, wherein the step of micromachining includes the step of forming the micro-sized structure in the substrate.

7. A method in accordance with claim 4, further comprising the step of removing the photoresist from the first region using photolithographic techniques.

8. A method in accordance with claim 1, wherein step (b) includes the step of controlling the thickness of the coating material to be within a predetermined range, said predetermined range being sufficient (1)to withstand the electrolyte, and (2) to be removed by a process used to form the micro-sized structure.

9. A method in accordance with claim 1, further comprising the step of forming the micro-sized structure using one of the group consisting of micro-electro discharge machining, micro drilling, laser-chemical micro-machining and silicon micro-machining.

10. A method in accordance with claim 1, wherein step (c) includes:

(1) micro-machining the coating material; and (2) micro-machining the substrate, to form the exposed micro-sized structure.

11. A method in accordance with claim 1, further comprising the step of applying an adhesion promoter to the substrate before step (b).

12. A method in accordance with claim 11, wherein the step of applying the adhesion promoter includes the step of spin coating the substrate with the adhesion promoter.

13. A method in accordance with claim 1, wherein step (b) includes the step of spin coating the substrate with the coating material.

14. A method in accordance with claim 1, wherein step (d) includes selectively applying the electrolyte to a portion of the substrate that includes the first region.

15. A method in accordance with claim 14, wherein the step of selectively applying the electrolyte includes the steps of:

positioning the tube having a seal on the portion of the substrate that includes the first region; and introducing the electrolyte into the tube.

16. A method for polishing a substrate having at least one micro-sized structure, comprising the steps of:

(a) identifying a first region of the substrate on which a micro-sized structure is to be located, and on which first region polishing is desired, and a second region of the substrate, such that polishing is not desired in the second region;

(b) coating the substrate with a selected coating material that does not degrade substantially when exposed to a selected electrolyte;

(c) removing the coating from the first region using one of the group consisting of chemical etching and plasma etching, to expose the micro-sized structure;

(d) exposing the first region of the substrate to the electrolyte; and (e) electropolishing the first region of the substrate;

(f) removing the coating from the second region using one of the group consisting of chemical etching and plasma etching.

17. A method for polishing a substrate having at least one micro-sized structure, comprising the steps of:

(a) identifying the first region of the substrate on which the micro-sized structure is located, and a second region of the substrate;

(b) applying an adhesion promoter to the substrate;

(c) coating the substrate with a selected coating material that does not degrade substantially when exposed to a selected electrolyte;

(d) removing the coating from the first region, to expose the micro-sized structure;

(e) submerging the substrate in the selected electrolyte so that the first region is exposed to the electrolyte;

(f) electropolishing the first region of the substrate; and (g) removing the coating material from the second region.

18. A method in accordance with claim 17, further comprising the step of forming the micro-sized structure before step (b).

19. A method in accordance with claim 17 wherein step (d) includes the step of micro-machining the substrate to remove the coating and to form the micro-sized structure.

20. A method for polishing a substrate having at least one micro-sized structure, comprising the steps of:

(a) identifying a first region of the substrate on which a micro-sized structure is to be located, and a second region of the substrate;

(b) applying a layer of adhesion promoter to the substrate;

(c) coating the substrate with a layer of photoresist;

(d) micro-electro-discharge machining the coating material and substrate in the first region, forming an exposed micro-sized structure in the substrate;

(e) submerging the substrate in an electrolyte so that the first region is exposed to the electrolyte; and (f) electropolishing the first region of the substrate; and (g) plasma etching the substrate to remove the photoresist.

* * * * *

UNITED STATES PATENT AND TRADEMARK OFFICE

CERTIFICATE OF CORRECTION

PATENT NO. : 5,378,330
DATED : January 3, 1995
INVENTOR(S) : Li et al.

It is certified that error appears in the above-identified patent and that said Letters Patent is hereby corrected as shown below:

Cover Page, left column, before "[21] Appl. No.", insert --[73] Assignee: Panasonic Technologies, Inc. and The Massachusetts Institute of Technology, both of Cambridge, Mass.--.

Column 4, line 11, delete "Am ask" and insert --A mask--.

Column 7, line 23, before the word "first" delete "the" and insert --a--.

Signed and Sealed this

Thirteenth Day of June, 1995

*Attest:*

Bruce Lehman

BRUCE LEHMAN

*Attesting Officer*

*Commissioner of Patents and Trademarks*